US008955948B2

(12) United States Patent
Rolland

(10) Patent No.: US 8,955,948 B2
(45) Date of Patent: Feb. 17, 2015

(54) DEVICE FORMING A CONTINUOUS INKJET PRINTER CABINET WITH REDUCED CONCENTRATIONS OF SOLVENT VAPOR INSIDE AND AROUND THE CABINET

(75) Inventor: Nicolas Rolland, Vienne (FR)

(73) Assignee: Markem-Imaje, Bourge-les-Valence (FR)

( * ) Notice: Subject to any disclaimer, the term of this patent is extended or adjusted under 35 U.S.C. 154(b) by 256 days.

(21) Appl. No.: 13/576,209

(22) PCT Filed: Jan. 31, 2011

(86) PCT No.: PCT/EP2011/051283

§ 371 (c)(1),
(2), (4) Date: Jul. 31, 2012

(87) PCT Pub. No.: WO2011/092321

PCT Pub. Date: Aug. 4, 2011

(65) Prior Publication Data

US 2012/0306949 A1 Dec. 6, 2012

Related U.S. Application Data

(60) Provisional application No. 61/305,671, filed on Feb. 18, 2010.

(30) Foreign Application Priority Data

Feb. 1, 2010 (FR) ..... 10 50677

(51) Int. Cl.
*B41J 2/17* (2006.01)
*B41J 29/377* (2006.01)
*B41J 29/02* (2006.01)

(52) U.S. Cl.
CPC ..... *B41J 29/377* (2013.01); *B41J 29/02* (2013.01)
USPC ..... 347/84; 347/6; 347/7; 347/34; 347/36; 347/85

(58) Field of Classification Search
CPC ..... B41J 29/377
USPC ..... 347/84
See application file for complete search history.

(56) References Cited

U.S. PATENT DOCUMENTS 4,199,767 A 4/1980 Campbell et al.
4,520,366 A 5/1985 Gragin (Continued)

FOREIGN PATENT DOCUMENTS

CN 1403885 A 3/2003
CN 101151158 A 3/2008

(Continued)

OTHER PUBLICATIONS

International Search Report issued May 16, 2012 in International Application No. PCT/EP2012/052083.

(Continued)

*Primary Examiner* — Manish S Shah
*Assistant Examiner* — Jeffrey C Morgan
(74) *Attorney, Agent, or Firm* — Miles & Stockbridge P.C.

(57) ABSTRACT

The invention concerns a device forming a continuous inkjet printer cabinet including a combined ventilation system for the electronic compartment and consumable fluids compartment (ink and solvent). According to the invention, condensates derived from solvent vapors not condensed by the condenser are extracted through a pipe then retained in order to be evaporated by the ventilation airflow. The solution according to the invention ensures that the increase in solvent concentration around the printer remains below the legal limits for unpleasant smells for persons. One advantageous embodiment consists of using a heat exchanger on the ventilation airflow path, to condensate solvent vapor in the ink reservoir to enable gravity flow of vapors thus condensed and return them to the ink reservoir.

10 Claims, 3 Drawing Sheets

(56) References Cited

U.S. PATENT DOCUMENTS

| | | | | |
|---|---|---|---|---|
| 4,567,494 | A | 1/1986 | Taylor | |
| 4,600,326 | A | 7/1986 | Fudatsuji et al. | |
| 4,671,371 | A | 6/1987 | Shimizu | |
| 4,730,197 | A | 3/1988 | Raman et al. | |
| 5,055,856 | A | 10/1991 | Tomii et al. | |
| 5,103,244 | A | 4/1992 | Gast et al. | |
| 5,260,724 | A | 11/1993 | Tomii et al. | |
| 5,512,924 | A | 4/1996 | Takada et al. | |
| 5,574,485 | A | 11/1996 | Anderson et al. | |
| 5,659,342 | A | 8/1997 | Lund et al. | |
| 5,808,642 | A | 9/1998 | Zaba et al. | |
| 5,907,335 | A | 5/1999 | Johnson et al. | |
| 6,247,781 | B1 | 6/2001 | Blum | |
| 6,250,736 | B1 | 6/2001 | Wojcik | |
| 6,254,216 | B1 | 7/2001 | Arway et al. | |
| 6,273,559 | B1 | 8/2001 | Vago et al. | |
| 6,290,323 | B1 | 9/2001 | Sharma et al. | |
| 6,347,858 | B1 | 2/2002 | Faisst, Jr. et al. | |
| 6,435,347 | B1 | 8/2002 | Brown | |
| 6,505,921 | B2 | 1/2003 | Chwalek et al. | |
| 6,536,863 | B1 | 3/2003 | Beauchamp et al. | |
| 6,550,889 | B2 | 4/2003 | Colombat et al. | |
| 6,575,556 | B1 | 6/2003 | Eremity et al. | |
| 6,688,722 | B2 | 2/2004 | Uchida et al. | |
| 7,033,003 | B2 | 4/2006 | Martin et al. | |
| 7,055,931 | B2 | 6/2006 | West et al. | |
| 7,128,410 | B2 | 10/2006 | Levin et al. | |
| 7,144,103 | B2 | 12/2006 | Bowling et al. | |
| 7,178,897 | B2 | 2/2007 | Huliba | |
| 7,192,121 | B2 | 3/2007 | Barbet et al. | |
| 7,273,270 | B2 | 9/2007 | Katerberg | |
| 7,946,693 | B2 | 5/2011 | Pechtl | |
| 8,104,878 | B2 | 1/2012 | Montz et al. | |
| 8,162,450 | B2 | 4/2012 | Barbet | |
| 2003/0043239 | A1 | 3/2003 | Yamada et al. | |
| 2003/0179260 | A1* | 9/2003 | Anderson et al. | 347/25 |
| 2003/0214566 | A1 | 11/2003 | Miyazaki et al. | |
| 2005/0206673 | A1 | 9/2005 | Levin et al. | |
| 2005/0235652 | A1 | 10/2005 | Iwasaki | |
| 2006/0055726 | A1 | 3/2006 | Huliba | |
| 2009/0195629 | A1 | 8/2009 | Yamada et al. | |
| 2009/0303285 | A1 | 12/2009 | Matsuhashi | |
| 2010/0033543 | A1 | 2/2010 | Piatt et al. | |
| 2010/0045753 | A1 | 2/2010 | Barbet | |
| 2011/0141207 | A1* | 6/2011 | Fost et al. | 347/84 |
| 2011/0216136 | A1 | 9/2011 | Barbet | |
| 2012/0299989 | A1 | 11/2012 | Prothon et al. | |
| 2012/0327145 | A1 | 12/2012 | Pouzet | |

FOREIGN PATENT DOCUMENTS

| | | | |
|---|---|---|---|
| CN | 101253047 | A | 8/2008 |
| CN | 101267894 | A | 9/2008 |
| CN | 101417559 | A | 4/2009 |
| EP | 0 013 504 | A1 | 7/1980 |
| EP | 0 390 283 | A1 | 10/1990 |
| EP | 0 586 844 | A1 | 3/1994 |
| EP | 0 949 077 | A1 | 10/1999 |
| EP | 1 002 649 | A2 | 5/2000 |
| EP | 1 074 389 | A2 | 2/2001 |
| EP | 1 074 389 | A3 | 5/2001 |
| EP | 1 162 518 | A2 | 12/2001 |
| EP | 1 002 649 | A3 | 4/2002 |
| EP | 1 750 334 | A1 | 2/2007 |
| FR | 2471278 | A | 6/1981 |
| FR | 2814395 | A1 | 3/2002 |
| FR | 2938207 | A1 | 11/2005 |
| FR | 2906755 | A1 | 11/2008 |
| FR | 2 954 215 | A1 | 6/2011 |
| FR | 2 954 216 | A1 | 6/2011 |
| RU | 2055319 | | 2/1996 |
| WO | WO 88/01572 | A | 3/1988 |
| WO | WO 94/19197 | A1 | 9/1994 |
| WO | WO 2006/067227 | A1 | 6/2006 |
| WO | WO 2007/042530 | A | 4/2007 |
| WO | WO 2008/040777 | A | 4/2008 |

OTHER PUBLICATIONS

Corrected Notice of Allowance issued Jan. 11, 2013 in U.S. Appl. No. 13/128,860.
Notice of Allowance issued Nov. 26, 2012 in U.S. Appl. No. 13/128,860.
Office Action issued Mar. 16, 2012 in U.S. Appl. No. 12/743,526.
Office Action issued Aug. 16, 2012 in U.S. Appl. No. 13/126,166.
Office Action issued Jun. 2, 2014 in U.S. Appl. No. 13/983,544.

* cited by examiner

DEVICE FORMING A CONTINUOUS INKJET PRINTER CABINET WITH REDUCED CONCENTRATIONS OF SOLVENT VAPOR INSIDE AND AROUND THE CABINET

CROSS-REFERENCE TO RELATED APPLICATIONS

This application is a U.S. national stage entry under 35 U.S.C. §371 of International Application No. PCT/EP2011/051283, filed Jan. 31, 2011, which claims the benefit of U.S. Provisional Application No. 61/305,671, filed Feb. 18, 2010, all of which are hereby incorporated by reference herein in their entirety.

TECHNICAL FIELD

The invention relates to continuous inkjet printers using ink with a volatile solvent, a part of which that is not used for printing being permanently recycled by the ink circuit.

During recycling, the ink solvent evaporates and can escape inside and/or around the printer.

More precisely, the invention relates to reducing the concentration of solvent vapor inside and around the printer, such that it remains below legal limits.

PRIOR ART

Continuous inkjet printers are widely used in the field of coding and industrial marking for various products, for example to mark barcodes or the expiration date on food products directly on the production line and at high speed. This type of printer is also found in certain decorative fields where the graphic printing possibilities of the continuous inkjet technology are used.

Continuous inkjet printers generally comprise a cabinet and a print head usually offset from the cabinet to which it is connected by an umbilical. Printer cabinets currently marketed usually comprises two compartments, a first compartment that acts as a housing for electronic control elements and the electrical power supply to the fluid circuit and the print head, including the controller electronic card, low voltage electrical power supplies and often user interface elements (operator) and a second compartment that acts as a housing for most fluid circuits such as ink and solvent reservoirs and hydraulic components. Throughout the remainder of this disclosure, the former compartment is referred to as the "electronic compartment" and the latter compartment is referred to as the "consumable fluids compartment", for reasons of clarity.

In the design of cabinets, an attempt is usually made to isolate the electronic compartment from the consumable fluids compartment, to prevent problems due to contact of solvent with electrical/electronic components in operation.

It is also planned that forced ventilation systems can be used inside cabinets, the first function of which is to evacuate heat generated by the different components and to refresh internal air that might contain solvent vapor. These forced ventilation systems are designed either independently for each compartment, or in a combined manner for the two compartments.

In the first case, each compartment comprises an external air inlet and its own extraction fan; for example this is the case for printers marketed by the Videojet Company under the trade name 1510 or by the Rottweil Company under the trade name C Series. In the second case, a fan circulates air from outside the cabinet, firstly into the electronic compartment and secondly into the consumable fluids compartment (ink and solvent) in sequence; for example this is the case for printers marketed by the Domino Company under the trade name A series and by the applicant, Markem-Imaje, under the trade name 9020 series.

The widely known operating principle for continuous inkjet printers is that a pressurized ink circuit containing ink mixed with a solvent supplies a print head in which a jet of ink drops is formed. The drops that are not used for printing are drawn in by a recovery gutter kept at a negative pressure by the ink circuit. Under this negative pressure, the gutter draws in air from outside the ink circuit that is combined with ink that is not used for printing, in a two-phase mix (air and ink mixed with solvent) that returns to the ink circuit through a pipe in the umbilical. When the air reaches the ink circuit, it is saturated with solvent vapor. Since it has been drawn from outside the printer, it is in excess in the ink circuit and therefore must be evacuated outside the ink circuit.

Prior art knows two essential types of solutions to deal with this excess air saturated in solvent vapor.

A first type of solution is the most widely used and in particular is that applied to printers marketed by the Imaje Company under the trade name S8, by the Domino Company under the trade name A series, by the Videojet Company under the trade name Excel, by the Linx Company under the trade name 4900 and by the Hitachi Company under the trade name PX. This type of solutions applies to ink circuits in which the consumable fluid reservoirs (ink reservoir and solvent reservoir) are permanently in communication with the internal environment of the consumable fluids compartment through vents. In this case, this first type of solution consists of using the forced ventilation, the primary function of which is to dissipate heat, in order to bring a fresh air flow (not containing solvent) into the consumable fluids compartment. The advantage of this first type of solution is that volatile solvent vapors in the excess air returned into the ink circuit are mixed with the outdoor fresh airflow. The major disadvantages are that:

- it facilitates evaporation of solvent that has not yet been used, in other words that is present in the solvent reservoir and in the ink in the ink reservoir and that escapes from the vents, which leads to the consumption of more solvent than is necessary for printing,
- nevertheless, the solvent concentration may remain high inside the consumable fluids compartment and it can expose the operator to a high solvent vapor content when opening the compartment access door (for example to replace the consumables). If the ink solvent is a cetonic or alcohol compound, inhalation of these vapors may be noxious when their concentration exceeds values defined by the legislation for the safety of persons. This legislation imposes threshold values that are independent of the solvent used and that must be not exceeded. For example, French legislation defines one of the threshold value called "Exposure Limit Value" (VLE in French, ELV) as being the maximum value that must never be exceeded for a maximum duration of fifteen minutes; it is fixed at 300 ppm (parts per million). In other words, in this case the ELV may be exceeded when the consumable fluids compartment access door is open. Another limiting value defined by French legislation is the "Mean Exposure Limit Value" (VME) and is equal to the maximum value that must never be exceeded for a duration of eight hours per day and forty hours per week; this value is fixed at 200 ppm. These ELV and VME values defined by the French legislation correspond to values referred to as TLV/TWA and TLV/STEL respectively by the official organization in the United States of America (American Conference of Governmental Industrial Hygienists ACGIH).

Note here that in all the figures, the grey curved arrows represent forced ventilation flows, while the black arrows represent airflows containing solvent vapor.

FIG. 1 shows the diagram of an architecture of a printer cabinet according to prior art embodying this first type of solution. It typically concerns the printer marketed by the Domino Company under the trade name A300. In this FIG. 1, the air inlet 5 is at the bottom of the cabinet and air rises through a duct 19 as far as the electronic compartment 1. This forced ventilation is created by negative pressure using the single fan 4 that extracts air from the electronic compartment 1 towards the consumable fluids compartment 2. The negative pressure in the electronic compartment 1 created on the upstream side of fan 4 is balanced by air arriving from the air inlet 5, and the overpressure created in the consumable fluids compartment 2 on the downstream side of the fan 4 is rebalanced because air escapes through a mesh that opens up on the bottom 20 of said compartment 2 leading to the outside bypassing a protection plate 22. This protection plate prevents direct entry of foreign bodies or liquid through the outlet 15 (Minimum IP protection index). In the printer considered, the fluids circuit comprises an intermediate reservoir 8 inside which the ink is prepared (adjusted viscosity) before supplying the head through a pressurization system 11 (pump) through a duct 17 in an umbilical. The intermediate reservoir 8 also receives the two-phase mix recovered from the head at the gutter and drawn in by the negative pressure generator 12 through the duct 16 in the umbilical. Excess air saturated in solvent vapor and ink evaporation gases escape inside the compartment 2. This compartment 2 also houses a solvent reservoir 18, the evaporation gases of which also escape into the internal environment. In this case, the solvent reservoir 18, the ink reservoir 8 and the various hydraulic components control operation of the consumable fluids circuit forming a block 10.

A second type of solutions is less widely used and for example concerns printers marketed by the Imaje Company under the trade names 9020 and 9030 and by the Videojet Company under the trade name 1510. This type of solution applies to ink circuits in which consumable fluid reservoirs (ink reservoir and solvent reservoir) are integrated into a single block that is made as leak tight as possible relative to the compartment in which it is housed. This block also comprises a single vent to evacuate excess air containing solvent vapors drawn in by the gutter and fluid evaporation gases contained in the block. This air is evacuated to the outside through a pipe connected to the block vent. The main advantage is that there is no high concentration of solvent vapor inside the consumable fluids compartment. Furthermore, high concentration vapors inside the block cannot come into contact with elements that could cause an explosion. The main disadvantage is that there is a risk of a very high concentration at the outlet from the pipe connected to the vent, and there is even a risk of condensation of solvent along the pipe and therefore a risk of liquid solvent escaping into the external environment close to the printer, which is formally prohibited by safety standards in force. Thus, in order to prevent any risk of liquid solvent escaping into the external environment, the applicant has already proposed additional means at the outlet from the pipe and located outside the printer cabinet. These additional means consist either of means used to bubble saturated air through water to dissolve the solvent vapors, or hydraulic connection means with the pipe to bring the solvent vapors into a zone in which there are no problems regarding safety standards. In an industrial environment in which the printers are used close to a production line, these connection means may comprise the entire extraction column already present on site.

FIG. 2 shows the diagram for a printer cabinet architecture making use of this second type of solution. Typically, it concerns the printer marketed by the Markem-Imaje Company under the trade name 9020. As can be seen on this figure, consumable fluid reservoirs (ink reservoir and solvent reservoir) and hydraulic components such as the ink supply pump and the suction pump are integrated into a single block 10 that is made as leak tight as possible from the compartment 2 in which it is housed. The single fan 13 extracts (only) ventilation air from the consumable fluids compartment 2 through an exit 15. To rebalance the negative pressure, air is drawn in from the electronic compartment 1. Air from this electronic compartment 1 is fed back through the air inlet 5 located under the machine and through a foam protection filter symbolically shown with a grey background. The vent outlet 21 from the pipe connected to the vent of block 10 is distinct from and at a distance from the ventilation air outlet from the electronic compartment and the consumable fluids compartment 2. Thus, air containing solvent vapor exits directly from the printer cabinet. Additional means at the vent outlet 21 from the pipe not shown and as described above are also provided outside the printer cabinet.

In addition to everything presented above, it must be considered that most inks used by all continuous inkjet printers are volatile solvent inks (for example Methyl Ethyl Acetone (MEK) or alcohol). The major disadvantage of these MEK or alcohol based inks is that they are flammable and that solvent vapors are also flammable (or even explosive) if the concentration is above certain limits. Thus, for safety reasons, UL safety standards impose that the mean concentration of solvent in air must be less than a quarter of a value called the "Lower Explosive Limit" (LEL). This LEL value is equal 18000 ppm (parts per million) for MEK and 115000 ppm for alcohol.

Another disadvantage is the unpleasant vapor odor that develops at a concentration of between 20 and 70 ppm for MEK, depending on individuals.

Thus, the disadvantages of the two types of state-of-the-art solutions described above for processing this excess air saturated with solvent vapor may be unacceptable when the ink used is based on MEK or alcohol.

Therefore the disadvantages of printer cabinets according to prior art comprising a combined system for ventilation of the electronic and consumable fluid compartments and means of treating excess air in the ink circuit saturated with solvent vapor, can be summarized as follows.

Cabinets comprising a consumable fluids compartment in which the ink and solvent reservoirs are housed and provided with a vent in communication with the internal environment in the compartment may contain a high concentration of solvent vapors in said compartment. The risk with this high concentration inside the compartment is that the explosive limit LEL may be exceeded for MEK or alcohol based inks, if there is a fan failure. Furthermore, the ELV "Exposure Limit Value" may be exceeded when said consumable fluids compartment access door is opened.

Cabinets in which ink and solvent reservoirs and hydraulic components such as ink feed pumps and suction pumps are integrated in a block that is as leak tight as possible relative to the consumable fluids compartment, may have a locally very high solvent vapor concentration at the outlet from the vent pipe creating a zone close to the printer and accessible to an operator in which the ELV may be largely exceeded. The risks with this very high local concentration outside the compartment, when a temperature gradient is set up between the inside and outside of the cabinet, are such that the solvent condensates in liquid form and the near environment of the cabinet is polluted by this solvent. Up to now, this made it necessary to install additional means outside printer cabinets (bubbling means or hydraulic connection to an extraction column).

One aim of the invention is to offer a solution that overcomes the above mentioned disadvantages of continuous inkjet printer cabinets according to prior art, and therefore to disclose a solution that is easy to implement and that can result in a solvent vapor concentration inside and at any point around the printer cabinet that is below legal limits, and preferably lower than concentrations that generate odors that most individuals find unpleasant.

PRESENTATION OF THE INVENTION

To this end, the invention proposes a device forming a continuous inkjet printer cabinet provided with a print head comprising a gutter for recovery of ink that will not be used for printing, the cabinet comprising:

- a first compartment, containing at least the electronic printer control components; the first compartment being in fluid communication with the outside through a first opening forming the air inlet opening,
- a second compartment, in fluid communication with the first compartment and in which at least one solvent reservoir and ink reservoir are housed, the ink reservoir being connected to the recovery gutter and comprising a vent capable of evacuating solvent vapors contained in the ink recovered by the gutter,
- a first fan to set up a forced airflow in the first and second compartments leading to outside the second compartment,
- a pipe connected to the ink reservoir vent in a sealed manner.

According to the invention, the cabinet also comprises:

- a third compartment in fluid communication firstly with the second compartment and secondly with the outside through a second opening forming the air outlet opening; the free end of the pipe opens up into the third compartment,
- a second fan hydraulically in series with the first fan to increase the airflow and maintain the forced airflow in the third compartment leading to the air outlet,
- means for retaining any condensates derived from non-condensed solvent vapors recovered at the free end of the pipe opening up in the third compartment, the forced airflow in the third compartment being capable of evaporating said condensates on the upstream side of the air outlet opening.

In other words, the solution according to the invention can prevent risks of an excessive solvent concentration both locally around the cabinet and inside the consumable fluids compartment.

Thus, according to the invention, the fans are placed hydraulically in series and the walls of the compartments ensure single-directional aeraulic isolation such that there can be no counter-current airflow from the air outlet to the air inlet.

Due to the leak tightness of the path followed by excess air containing solvent vapor drawn in from the recovery gutter in the head, this air containing solvent vapor circulates in a closed circuit as far as the third compartment without even partially entering into the other two compartments.

The zone provided in the third compartment into which the solvent vapor evacuation pipe and the eventual condensate retention means open up, is such that the condensates are trapped and necessarily vaporized by the ventilation airflow created by the downstream side fan.

Thus, the dilution of MEK vapors may be lower than the unpleasant smell threshold (~50 ppm) at the exit opening.

According to one advantageous embodiment, a heat exchanger is provided connected in a sealed manner between the reservoir vent and the pipe opening up into the third compartment; the heat exchanger being arranged so that it is on the path of at least part of the forced airflow set up by the first fan thus forming a separated fluids condenser capable of condensing some of the solvent vapors evacuated through the vent, and to enable gravity flow of the vapors thus condensed in return to the ink reservoir. Thus according to this mode, the consumption of solvent is reduced because part of the solvent vapors, condensed by the condenser from the heat exchanger, returns by gravity to the ink reservoir and is used once again for printing.

In other words, the retention means according to this mode are designed to retain only some of the solvents in the form of condensates that had not been condensed previously by the condenser.

Advantageously, a heat exchanger that integrates a Peltier effect cell may be used.

According to another advantageous embodiment, a partition may be placed in the second compartment on the upstream side of the ink and solvent reservoirs and comprising a first hole approximately in line with the heat exchanger, part of the forced airflow set up by the first fan being guided by said first hole. Thus, if the design is such that the first fan has to be located other than vertically in line with the heat exchanger, the add-on partition can redirect the airflow optimally to form an optimized separated fluids condenser. This may be advantageous for example when the arrangement of electronic components inside the electronic compartment imposes a fan location not vertically in line with the heat exchanger.

The partition may also comprise at least one second hole guiding the other part of the forced airflow set up by the first fan, this other part of the flow being guided so as to limit aeraulic disturbances on the hydraulic component(s) housed in the second compartment. As described subsequently, the component(s) in question is (are) sensitive to aeraulic disturbances such as a pressure sensor connected to a reservoir housed in the second compartment.

According to one advantageous embodiment, the retention means comprise a wall delimiting the third compartment and arranged vertically in line with the open end of the pipe, the length of the wall between a point vertically in line with the opening end and the air outlet being sufficiently large to allow complete evaporation of condensates output from the pipe through the forced airflow set up by the second fan. Therefore in this case no additional means need to be installed for the retention to allow for complete evaporation of solvent condensates at the outlet from the vent pipe.

It would also be possible to place the print head ink supply pump in the second fan flow so that it can be cooled by the second fan.

The third compartment may be fitted with baffles to guide the ventilation airflow as close as possible to the open end of the pipe.

The invention also relates to a continuous deviated inkjet printer comprising a cabinet like that described above.

Finally, the invention applies to the use of this printer for marking and/or coding of products in an industrial production line.

BRIEF DESCRIPTION OF THE DRAWINGS

Other characteristics and advantages of the invention will become clearer after reading the not-limitative detailed description given for illustrative purposes with reference to the following figures in which.

DETAILED PRESENTATION OF PARTICULAR EMBODIMENTS

Note once again that in all the figures, the curved grey arrows represent forced ventilation flows while the black arrows represent airflows containing solvent vapor.

Note also that the terms "upstream" and "downstream" refer to the direction of circulation of airflows and of air containing solvent vapor from a cabinet air inlet to the air outlet.

Note also throughout this disclosure, the expression "in fluid communication" means that there is at least one path through which a ventilation airflow can pass.

Figure 1:
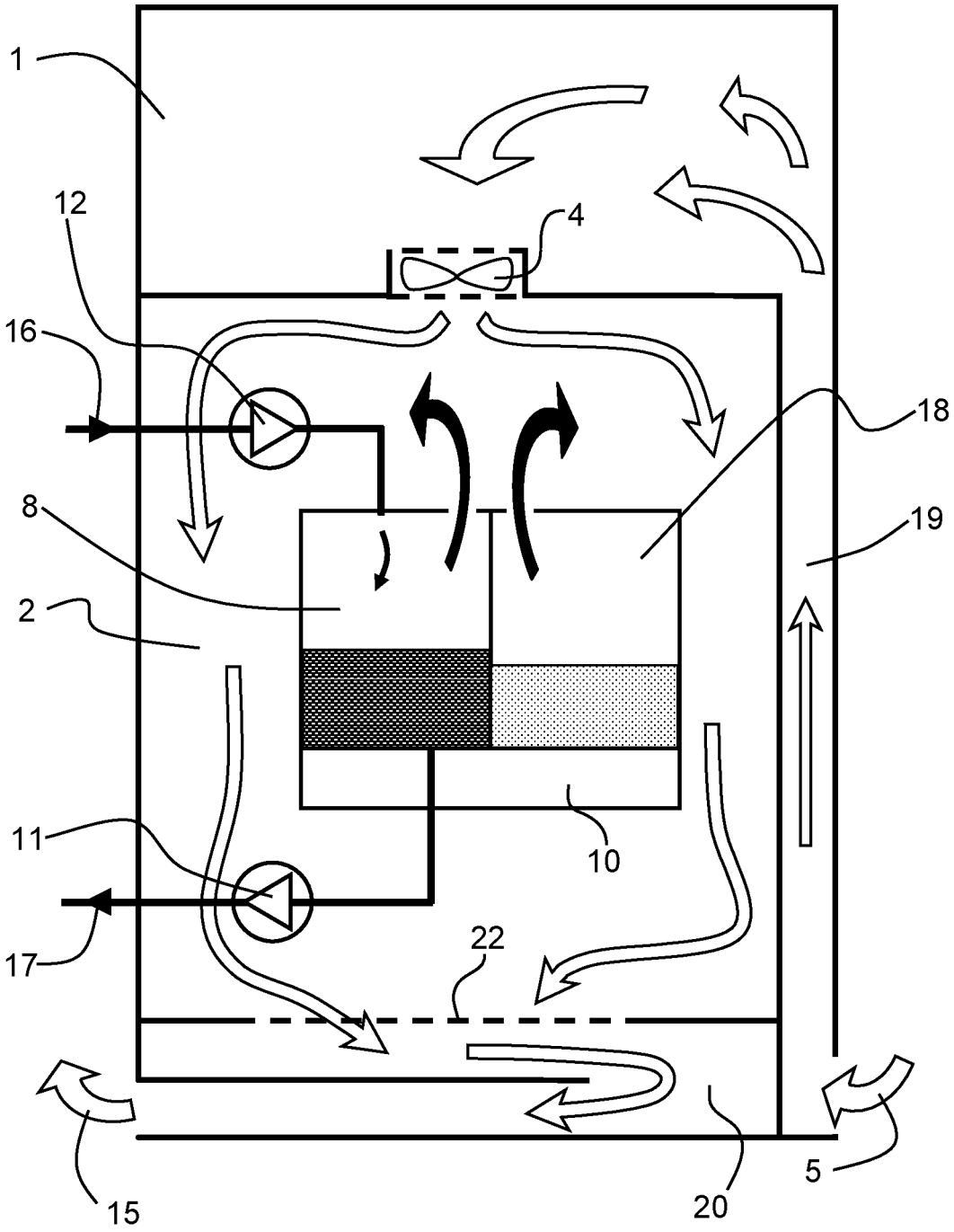
FIG. 1 is a diagram of a type of printer cabinet architecture according to prior art.
Figure 2:
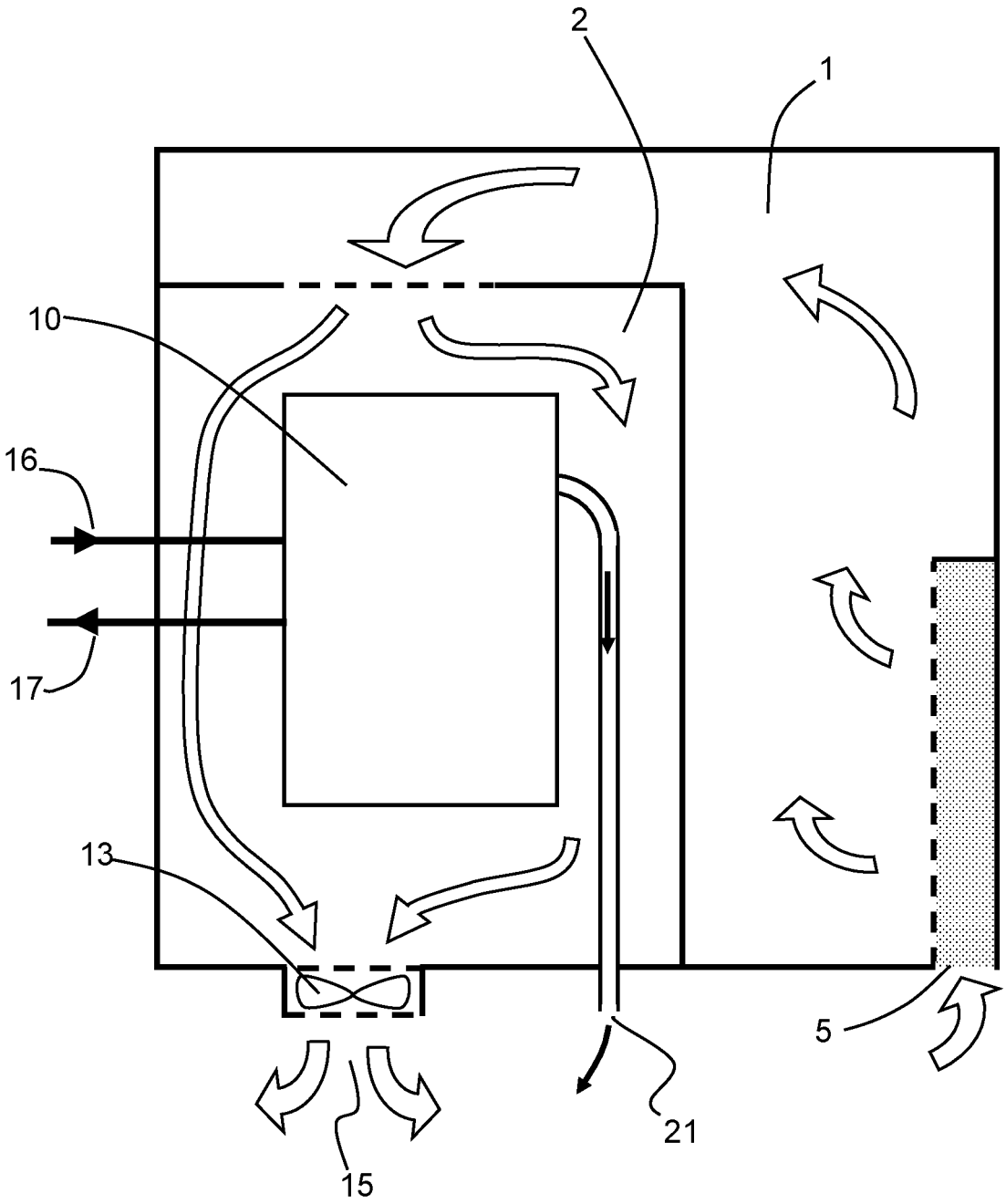
FIG. 2 is a diagram of another type of printer cabinet architecture according to prior art.

The architectures of state-of-the-art printer cabinets shown in FIGS. 1 and 2 have been commented upon in detail in the preamble. Therefore they are not described below.

The architecture of a continuous inkjet printer cabinet according to the invention will now be described with reference to FIG. 3. Note that the cabinet shown comprises stands P used to place the cabinet on a working surface (table or floor) as close as possible to the industrial production line of products to be marked and/or coded by the printer.

The cabinet according to the invention comprises firstly three compartments 1, 2, 3 in fluid communication with each other in series.

The first compartment 1 is in fluid communication with the outside through a first opening forming the air inlet opening 5, protected by a baffle and in this case provided with a protection medium to achieve leak tightness according to a class of at least IP54. This first compartment 1 is said to be the electronic compartment because its primary function is to house electronic components for the electrical power supply and to control the print head and the fluid circuit. Furthermore, a first fan 4 is arranged inside the electronic compartment 1 so as to extract air contained in it and therefore to evacuate heat released by the operation of electronic components. This air extracted from the electronic compartment 1 is replaced by air entering through the inlet opening 5. The trajectory of the airflow in the electronic compartment 1 is optimized by the relative position of the different elements (air inlet 5, electrical/electronic components (electronic circuit board, low voltage electrical power supply) fan 4, etc. . . . ).

The second compartment 2 is in fluid communication with the electronic compartment 1 only through the orifice in which the fan 4 is located. This second compartment 2 is called the consumable fluids compartment because its primary function is to house the main part of the consumable fluids circuit, namely the consumable fluids (ink and solvent) reservoirs for operation in printing and maintenance of the printer print head.

In this case, the consumable fluid reservoirs concerned are as described and claimed in the French patent application number FR 09 59504 filed under the applicant's name on Dec. 23, 2009. The content of this application forms an integral part of this application. Therefore the consumable fluid reservoirs are integrated into a single receptacle 10. More precisely, this single receptacle comprises an intermediate reservoir 8 through which ink is supplied under pressure to the print head. This reservoir 8 is said to be intermediate because it forms a storage buffer reservoir in which ink to be sent to the print head is prepared and stored in a part of the fluids circuit that is intermediate between the ink cartridges and the new solvent cartridges (removable consumable cartridges) and the print head itself. Thus, ink drawn from the intermediate reservoir 8 is pressurized by a first pump 11 to be sent to the head through a duct 17 in an umbilical.

Fluids returning from the print head from the gutter are recovered by the same intermediate reservoir 8. More precisely, these fluids are a two-phase ink/air mix containing solvent drawn in through the gutter. This two-phase mix returning from the head through the duct 16 in the umbilical is drawn in by a second pump 12. As described in application FR 09 59504, this second pump 11 may advantageously be made by a hydro-ejector supplied by the first pump 12. The two-phase ink/air mix containing solvent separates in the intermediate reservoir 8; returning ink flows to the bottom of the reservoir by gravity as long as air containing excess solvent vapor in the reservoir is evacuated through a vent 80 with minimum pressure losses to guarantee that the pressure remains stable equal to approximately atmospheric pressure inside the receptacle 10.

As shown, the vent 80 is in fluid communication with a heat exchanger 7 that may be passive or active and for example may be fitted with a Peltier effect cell, itself in fluid communication with an approximately vertical pipe 9. A seal is made from the vent 80 as far as the outlet from pipe 9. The pipe 9 is preferably chosen without any retention zone and is advantageously sized to have a diameter of the order of 10 mm.

As also shown, the second pump 12 through which the two-phase mix of ink/air containing solvent returns to the reservoir 8 is housed in the consumable fluids compartment 2.

Finally, there is a perforated partition 6 in which there are at least two holes 60, 61 in the consumable fluids compartment on the upstream side of the receptacle 10. One of the holes is approximately vertically in line with the heat exchanger 7 so that part of the forced airflow set up by the fan 4 is guided towards said heat exchanger 7. The other hole(s) 61 is (are) arranged to guide the other part of the forced airflow set up by the fan 4 into an area without any hydraulic components sensitive to aeraulic disturbances housed in said compartment 2. This is advantageously the case for the pressure sensor 151 described in the above mentioned patent application FR 09 59504. This perforated partition 6 also prevents an object or tool passing through the fan 4 from directly accessing live circuits in the electronic compartment 1. Since the compartment 2 access door is not necessarily secure, if partition 6 were not present, a person who wants to work inside the second compartment 2 would be able to accidentally insert simple tools or objects through the fan opening 4.

A second fan 13 is housed on the bottom of the consumable fluids compartment 2 so that ventilation air can be extracted to a third compartment 3. This third compartment is in fluid communication with the compartment 2 only through the orifice occupied by the fan 13. As shown, the third compartment 3 is arranged as a double bottom of the second compartment 2. This third compartment 3 is also fitted with baffles and opens up to the air outlet opening 15. The air outlet is arranged under the cabinet itself placed on a working surface. The stands P of the cabinet create a space of a few millimeters between the plane and the bottom of the cabinet. The combined effect of the small depth of the space and the baffles in the double bottom create a protection with at least an IP54 rating. The vent pipe 9 connected in a sealed manner to the heat exchanger 7 itself connected in a sealed manner to the reservoir 8, opens up at the end of one of the baffles. The pump 11 that feeds the print head with ink from the reservoir 8 is located inside the third compartment vertically in line with the second fan 13.

It may be considered that the cabinet architecture with compartments 1, 2, 3 shown and the fans 4 and 13 provided results in a single-directional aeraulic isolation between each of the compartments in fluid communication in series because air cannot travel in the reverse direction, in other words in the direction from the air outlet 15 to the air inlet 5.

We will now describe fluid operation inside the printer cabinet.

The first fan 4 extracts air from the electronic compartment 1 carrying heat dissipated by the electronic components. The pressure inside this electronic compartment 1 is balanced through the air inlet 5.

The airflow extracted from the electronic compartment 1 arrives from the outlet from fan 4 into the consumable fluids compartment 2. The perforated partition 2 then divides this airflow into two flows. Thus, the airflow guided by the hole(s) 61 passes through a zone in which there are no sensitive hydraulic components. The airflow guided by the hole 60 continuously sweep the outside of the heat exchanger 7 and contributes to dissipating heat passing through the wall of the heat exchanger to improve the thermal flow between the inside and outside of the heat exchanger. The result is thus a condenser 7 with separated fluids to cause condensation of solvent vapors contained in the air at the outlet from the vent 80. Part of the condensed or liquefied solvent vapors return by gravity flow to the reservoir 8. Air at the outlet from the condenser 7 also containing solvent vapors close to saturation, is carried outside the compartment 2 through the vertical pipe 9 in the third compartment 3.

Before exiting from the consumable fluids compartment 2, the reunited airflows extracted by fan 13 cool the ink supply pump 11 that is one of the main sources of heat from the consumable fluids circuit.

The ventilation airflow in compartment 3 is directed by baffles towards a zone 14 into which the pipe 9 connected in a sealed manner to the condenser 7 opens up. In this zone 14, the two flows (air flow from the fan 13 and airflow containing solvent vapors near saturation from pipe 9) mix. The zone 14 forms a sort of retention and evaporation zone for solvent vapors. Any condensates that flow from the pipe 9 onto the bottom of compartment 3 (wall 30) are retained and then vaporized by the airflow from the fan 13. More precisely, the horizontal wall 30 forming the bottom of the third compartment 3 and vertically in line with the opening end of the pipe 9 is sufficiently long between the point vertically in line with the opening end of the pipe 9 and the air outlet 15 to enable total evaporation of residual condensates. No quantity of solvent in liquid form can exit from the cabinet. Preferably, the horizontal wall 30 vertically in line with the pipe 9 is at least 10 cm long.

Figure 3:
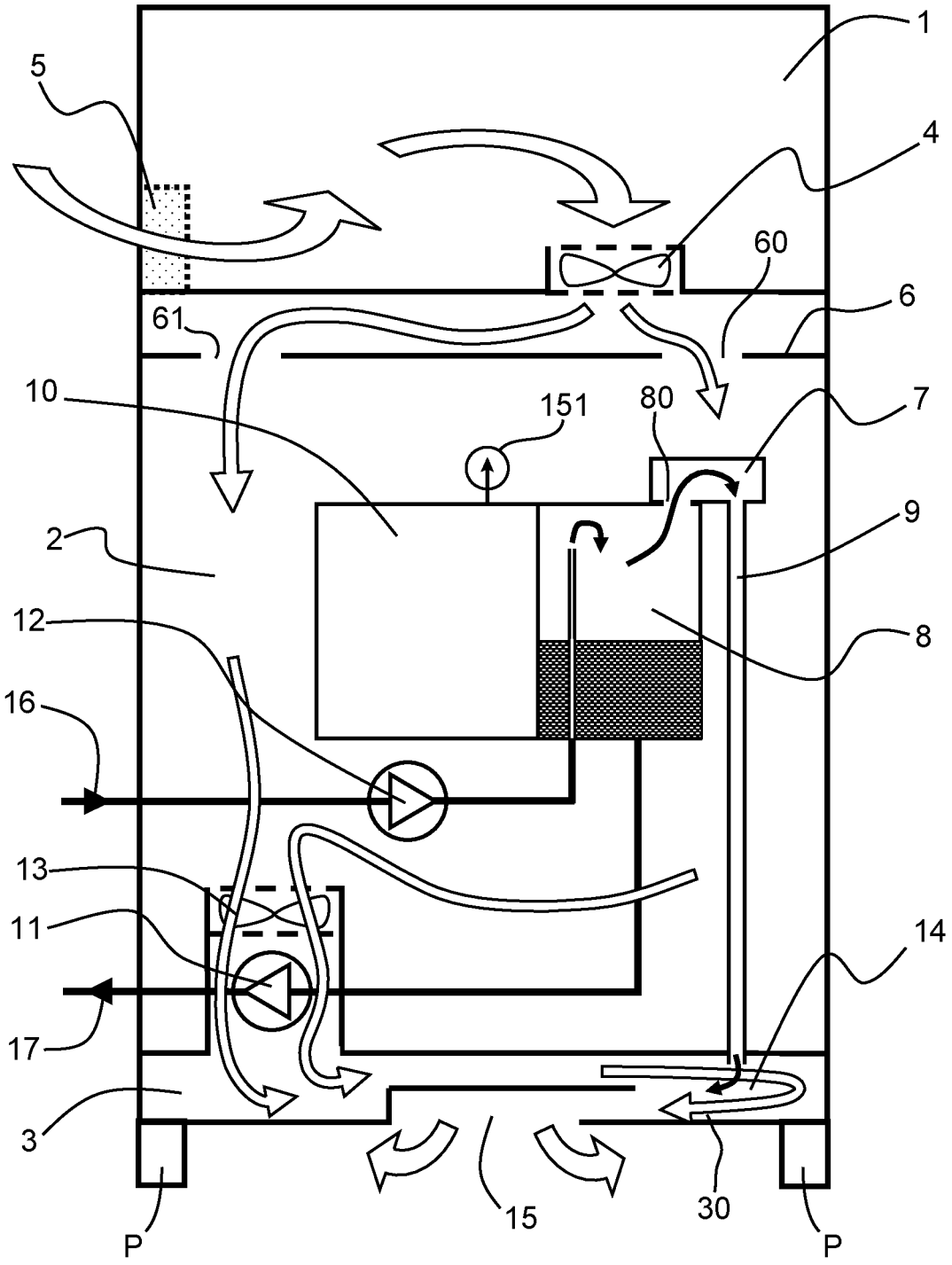
FIG. 3 is a diagram of a printer cabinet architecture according to the invention.

Measurements were made with the cabinet architecture according to the invention as shown in FIG. 3, and a consumable fluids circuit like that described and claimed in the above mentioned patent application FR 09 59504.

During printing, the airflow saturated with solvent vapor at the outlet from the pipe 9 is of the order of 6 l/h which corresponds to a recovery performance requirement at the gutter. This saturated air has a solvent vapor concentration that is dependent on the temperature that is itself variable along the air path (which is the reason for the presence of condensates in the heat exchanger 7 and in the pipe 9. To determine the quantity of solvent vapor output from the cabinet, it is preferred to measure the average solvent consumption that replaces the solvent lost by ink during operation of the printer.

The average solvent consumption was evaluated by the means described and claimed in French patent application FR 09 59501 also filed on Dec. 23, 2009, the content of which is entirely included in this application. This average consumption is used to deduce the experimentally obtained proportion of solvent evaporated at the head and that does not exit from the cabinet.

During printing, this average consumption of solvent outside the head is about 3 cc/h of MEK in liquid form, which corresponds to 0.9 l/h of MEK in vapor form at 20° C. In other words, since the only outlet from the cabinet for the solvent (vapor or condensate that will subsequently be vaporized) is the orifice of the pipe 9 opening up into the compartment 3, a flow equal to not more than 0.9 l/h of MEK in vapor form mixes with the ventilation flow and is evacuated through the air outlet orifice 15.

The two fans in series 4, 13 have been chosen to provide an air ventilation flow of between 16800 and 36000 Nl/h (Normal liters per hour).

The minimum value of this ventilation flow (16800 Nl/h) and the maximum flow of MEK in the form of vapor to be evacuated (0.9 l/h) at the outlet from pipe 9 can be used to calculate the minimum dilution factor $Fd_{min}$ of solvent vapors by the cabinet ventilation system according to the invention.

Therefore this minimum solvent vapor dilution factor is equal to approximately $Fd_{min}=16800/0.9=18700$.

In other words, it can be said that at worst, the cabinet according to the invention adds a solvent concentration of the order of 53 ppm ($\sim 1/Fd_{min}$) between the air inlet 5 and the air outlet 15.

This can be translated by the fact that with even for low air refreshment in the environment around the printer, the cabinet according to the invention can remain below the MEK smell threshold, assuring comfort for the user.

The printer cabinet according to the invention as described above for applications in which the printer is used for marking and/or coding products in an industrial production line has many advantages:

- no solvent vapor (zero concentration) is present in the electronic and consumable fluid compartments of the printer cabinet, which eliminates any risk of inflammation within the cabinet because the consumable fluids circuit is also leak tight and therefore there is no risk of solvent vapor coming into contact with an element that could trigger inflammation,
- there is no risk of the limiting solvent vapor concentrations defined by the safety legislation defined in the preamble (a quarter of the explosive limit LEL, and ELV when the solvents used are inherently inflammable or toxic such as MEK or alcohol) being exceeded, even locally around the cabinet. Furthermore, the average value of exposure of a person during a given VME period also defined by the legislation and equal to 200 ppm for an individual during a period of 8 hours/days and 40 hours/week is never exceeded, there is no risk of liquid solvent originating from condensates spilling outside the cabinet.

As a corollary, it is impossible to have a dangerous emanation of solvent vapor when opening the consumable fluids circuit compartment access door, as is frequently necessary to supply consumable fluids (ink and solvent) to the printer.

Finally, a printer user (operator) using a cabinet according to the invention and using MEK solvent based inks for printing is more comfortable because solvent vapors at the cabinet air outlet are emitted at a concentration of the same order or even less than the unpleasant smell threshold for most individuals (of the order of 50 ppm).

Other improvements can be made to the invention without going outside the scope of the invention.

Thus, although making the wall 30 of the third compartment 3 sufficiently long forms a simple and effective means of retaining solvent condensates at the exit from the vent pipe, it would also be possible to provide other means.

The invention claimed is:

1. A device forming a continuous inkjet printer cabinet provided with a print head comprising a gutter for recovery of ink that will not be used for printing, the cabinet comprising:

a first compartment containing at least electronic printer control components, the first compartment being provided in fluid communication with an outside of the first compartment through a first opening which forms an air inlet opening;

a second compartment provided in fluid communication with the first compartment and in which at least one solvent reservoir and ink reservoir are housed, the ink reservoir being connected to the recovery gutter and comprising a vent configured to evacuate solvent vapors contained in ink retrieved by the gutter;

a first fan to set up a forced airflow in the first and second compartments leading to an outside of the second compartment;

a pipe connected to the ink reservoir vent in a sealed manner;

a third compartment provided in fluid communication with the second compartment and with the outside through a second opening which forms an air outlet opening, wherein a free end of the pipe opens up into the third compartment;

a second fan hydraulically in series with the first fan and arranged to increase airflow and to maintain forced airflow in the third compartment leading to the air outlet; and means for retaining any condensates derived from non-condensed solvent vapors recovered at the free end of the pipe opening up in the third compartment, the forced airflow in the third compartment being configured to evaporate said condensates on an upstream side of the air outlet opening.

2. The printer cabinet according to claim 1, further comprising:

a heat exchanger connected in a sealed manner between the ink reservoir vent and the pipe opening up into the third compartment, wherein the heat exchanger is arranged to be on a path of at least part of the forced airflow set up by the first fan thus forming a separated fluids condenser configured to condense a portion of the solvent vapors evacuated through the vent, and to enable gravity flow of the vapors thus condensed in return to the ink reservoir.

3. The printer cabinet according to claim 2, in which the heat exchanger comprises a Peltier effect cell.

4. The printer cabinet according to claim 2, further comprising:

a partition placed in the second compartment on an upstream side of the ink and solvent reservoirs and comprising a first hole disposed approximately in line with the heat exchanger, wherein a part of the forced airflow set up by the first fan is guided by said first hole.

5. The printer cabinet according to claim 4, wherein the partition comprises at least one second hole guiding another part of the forced airflow set up by the first fan, said another part of the flow being guided so as to limit aeraulic disturbances on one or more hydraulic components housed in the second compartment.

6. The printer cabinet according to claim 1, wherein the retention means comprises a wall delimiting the third compartment and arranged in line with the open end of the pipe, and wherein a length of the wall between a point in line with the opening end and the air outlet is sufficiently large to allow complete evaporation of condensates output from the pipe through the forced airflow set up by the second fan.

7. The printer cabinet according to claim 1, wherein a print head ink supply pump is arranged to be in the second fan flow so that it can be cooled by the second fan.

8. The printer cabinet according to claim 1, in which the third compartment is fitted with baffles.

9. A deviated continuous inkjet printer, comprising:

a cabinet which includes a first compartment containing at least electronic printer control components, the first compartment being provided in fluid communication with an outside of the first compartment through a first opening which forms an air inlet opening;

a second compartment provided in fluid communication with the first compartment and in which at least one solvent reservoir and ink reservoir are housed, the ink reservoir being connected to the recovery gutter and comprising a vent configured to evacuate solvent vapors contained in ink retrieved by the gutter;

a first fan to set up a forced airflow in the first and second compartments leading to an outside of the second compartment;

a pipe connected to the ink reservoir vent in a sealed manner;

a third compartment provided in fluid communication with the second compartment and with the outside through a second opening which forms an air outlet opening, wherein a free end of the pipe opens up into the third compartment;

a second fan hydraulically in series with the first fan and arranged to increase airflow and to maintain forced airflow in the third compartment leading to the air outlet; and means for retaining any condensates derived from non-condensed solvent vapors recovered at the free end of the pipe opening up in the third compartment, the forced airflow in the third compartment being configured to evaporate said condensates on an upstream side of the air outlet opening.

10. A method for marking and/or coding products in an industrial production line using a deviated continuous inkjet printer, the method comprising:

providing a cabinet having a first compartment containing at least electronic printer control components, the first compartment being provided in fluid communication with an outside of the first compartment through a first opening which forms an air inlet opening;

providing, in the cabinet, a second compartment provided in fluid communication with the first compartment and in which at least one solvent reservoir and ink reservoir are housed, the ink reservoir being connected to the recovery gutter and comprising a vent configured to evacuate solvent vapors contained in ink retrieved by the gutter;

forcing airflow in the first and second compartments using a first fan to set up the forced airflow in the first and second compartments leading to an outside of the second compartment;

providing a pipe connected to the ink reservoir vent in a sealed manner;

providing a third compartment provided in fluid communication with the second compartment and with the outside through a second opening which forms an air outlet opening, wherein a free end of the pipe opens up into the third compartment;

forcing airflow in a third compartment using a second fan hydraulically in series with the first fan and arranged to increase airflow and to maintain forced airflow in the third compartment leading to the air outlet; and retaining any condensates derived from non-condensed solvent vapors recovered at the free end of the pipe opening up in the third compartment, the forced airflow in the third compartment being configured to evaporate said condensates on an upstream side of the air outlet opening.

* * * * *